US007714796B1

(12) United States Patent
Schumacher

(10) Patent No.: US 7,714,796 B1
(45) Date of Patent: May 11, 2010

(54) HEMISPHERICAL HELICAL ANTENNA AND SUPPORT FRAME THEREFOR

(76) Inventor: Mark H. Schumacher, 106 Ciccolella Ct., Southington, CT (US) 06489

( * ) Notice: Subject to any disclaimer, the term of this patent is extended or adjusted under 35 U.S.C. 154(b) by 926 days.

(21) Appl. No.: 11/493,186

(22) Filed: Jul. 26, 2006

Related U.S. Application Data

(60) Provisional application No. 60/708,169, filed on Aug. 15, 2005.

(51) Int. Cl.
*H01Q 1/42* (2006.01)
*H01Q 1/36* (2006.01)
*H01Q 11/08* (2006.01)

(52) U.S. Cl. ..... 343/872; 343/878; 343/895

(58) Field of Classification Search ..... 343/895, 343/872, 873, 878, 880
See application file for complete search history.

(56) References Cited

U.S. PATENT DOCUMENTS 2,919,442 A * 12/1959 Nussbaum ..... 343/895
5,808,585 A * 9/1998 Frenzer et al. ..... 343/872

* cited by examiner

*Primary Examiner*—Michael C Wimer
(74) *Attorney, Agent, or Firm*—Alix, Yale & Ristas, LLP

(57) ABSTRACT

A hemispherical helical antenna employs a support frame assembly. The support frame assembly is configured to align and stabilize the turns of the helical antenna element above the ground plane. The support frame assembly includes a plurality of panels manufactured from a dielectric material. The panels are disposed at a fixed angular orientation that defines a central axis and form a series of supports for the element.

20 Claims, 5 Drawing Sheets

HEMISPHERICAL HELICAL ANTENNA AND SUPPORT FRAME THEREFOR

CROSS-REFERENCE TO RELATED APPLICATIONS

This application claims priority under 35 U.S.C. §119(e) based on provisional application No. 60/708,169 filed Aug. 15, 2005.

BACKGROUND OF THE INVENTION

The helical antenna and its derivatives have been widely used in the field of communications for several decades. The helical antenna typically operates in the frequency ranges of 1 GHz and above. Many helical antennas resemble a coil of wire in the shape of a spring. As shown in FIG. 1A, wrapping the antenna wire on a cylinder is a relatively easy way to form the coils of a helical antenna. As shown in FIG. 1B, the cylinder used to construct the element is often incorporated into and becomes part of the antenna system. Helical antennas that operate at frequencies below 1 GHz tend to be more difficult to manage and construct because of their physical size and weight. For example, a 2 GHz helical antenna has a coil diameter of 2 inches while a 500 MHz helical antenna has a coil diameter of 8 inches. As a general rule, the larger coils of conventional helical antennas are supported by means of a main rod located in the center of the coil with smaller rods supporting the element.

The hemispherical helical antenna is a derivative of the helical antenna. Typically, hemispherical helical antennas exhibit a gain of approximately 8 dbi and are much smaller in axial length than a cylindrical helical antenna of similar gain. However, the coil shape of the hemispherical helical is significantly more challenging to form and support than the cylindrical helical antenna.

SUMMARY OF THE DISCLOSURE

A hemispherical helical antenna employs a support frame assembly which defines the geometry and provides the principal support structure for the antenna element. The support frame assembly includes a plurality of panels manufactured of dielectric material. The panels are configured to properly align and stabilize the spacing between the turns of the wire helical antenna element at specific locations above the ground plane of the antenna. Preferably, there are three panels disposed at a fixed angular orientation to one another about a central axis. Each panel is configured with a plurality of openings or supports that are equidistantly and radially spaced from a common center point on the particular panel. The openings may be slightly larger than the diameter of the element wire to allow the element to pass through the panels. A dome-like cover may enclose the element and the support frame.

DETAILED DESCRIPTION OF THE PREFERRED EMBODIMENTS

Figure 1A:
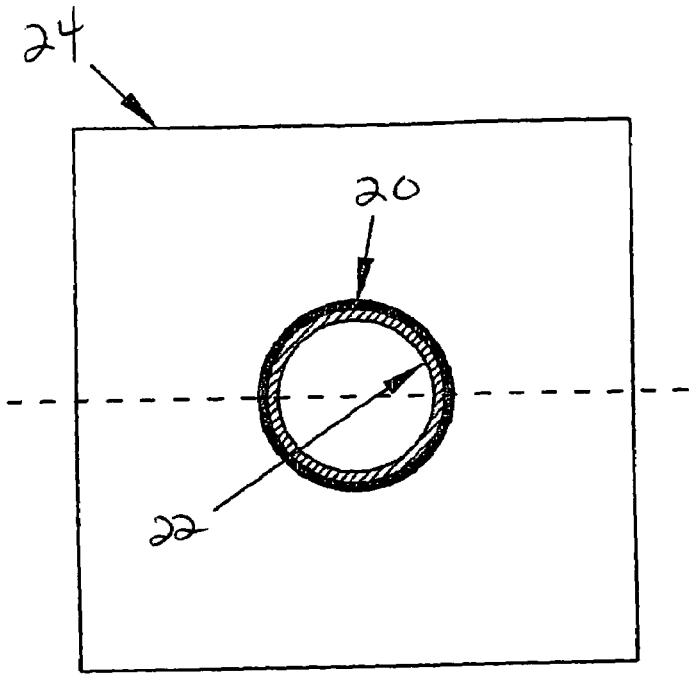
Figure 1A PRIOR ART
FIG. 1A is a top plan view, partly in diagrammatic form, of a typical prior art cylindrical helical antenna.
Figure 1B:
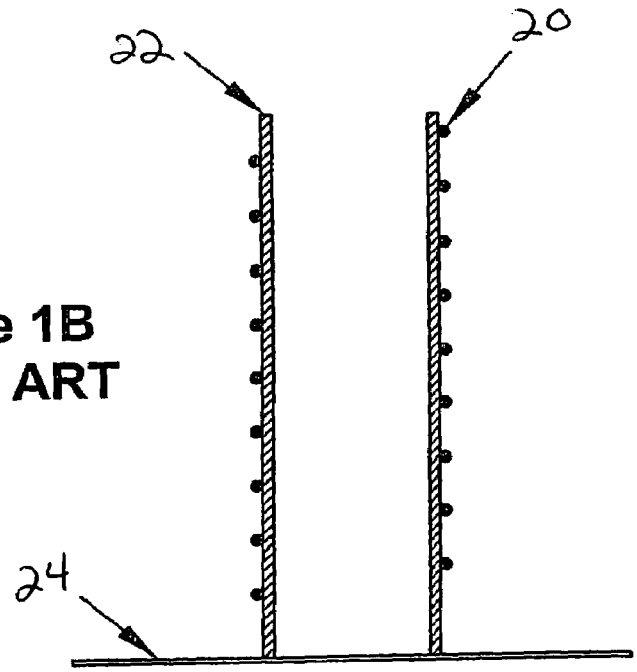
Figure 1B PRIOR ART
FIG. 1B is a side elevational view, partly in section and portions removed, of a typical prior art cylindrical helical antenna.
Figure 2A:
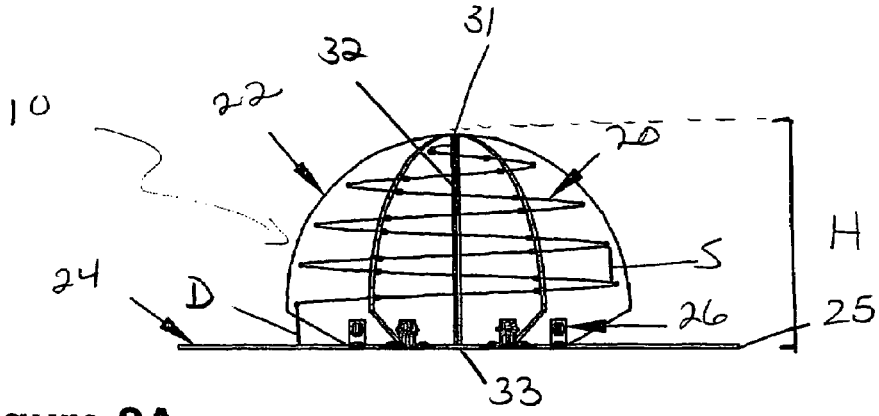
FIG. 2A is a side elevational view, partly in representational form, of an embodiment of a hemispherical helical antenna.
Figure 2B:
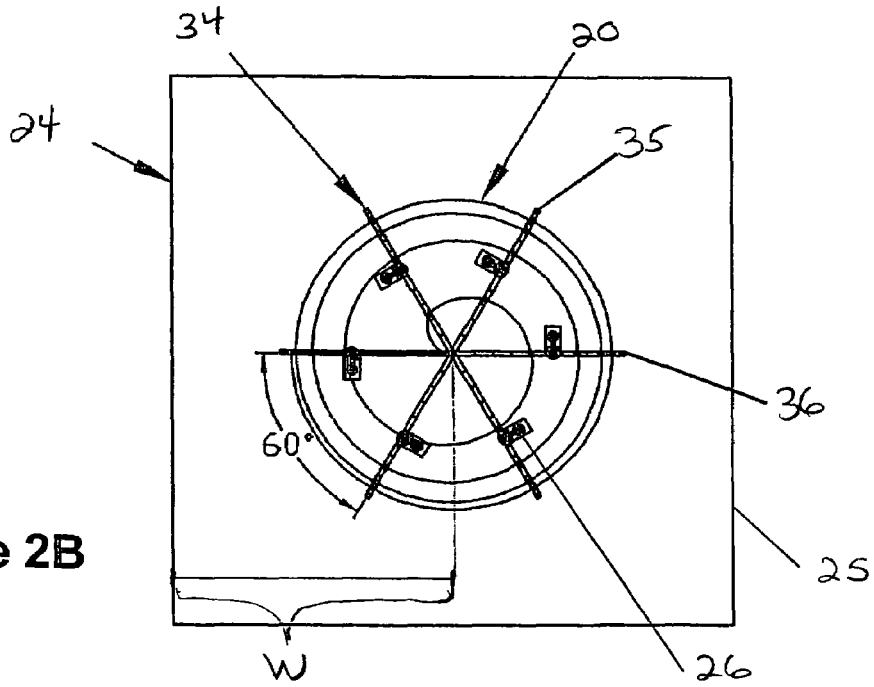
FIG. 2B is a top view, partly in representational and diagrammatic form, of the embodiment of FIG. 2A.
Figure 2C:
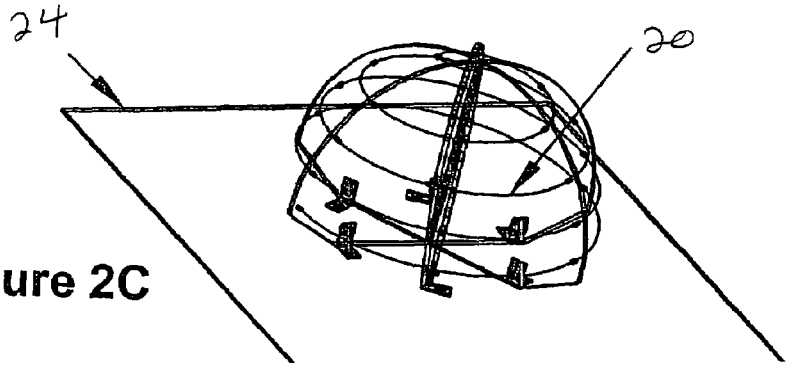
FIG. 2C is a perspective view, partly in representational form, of the embodiment of FIG. 2A.
Figure 5:
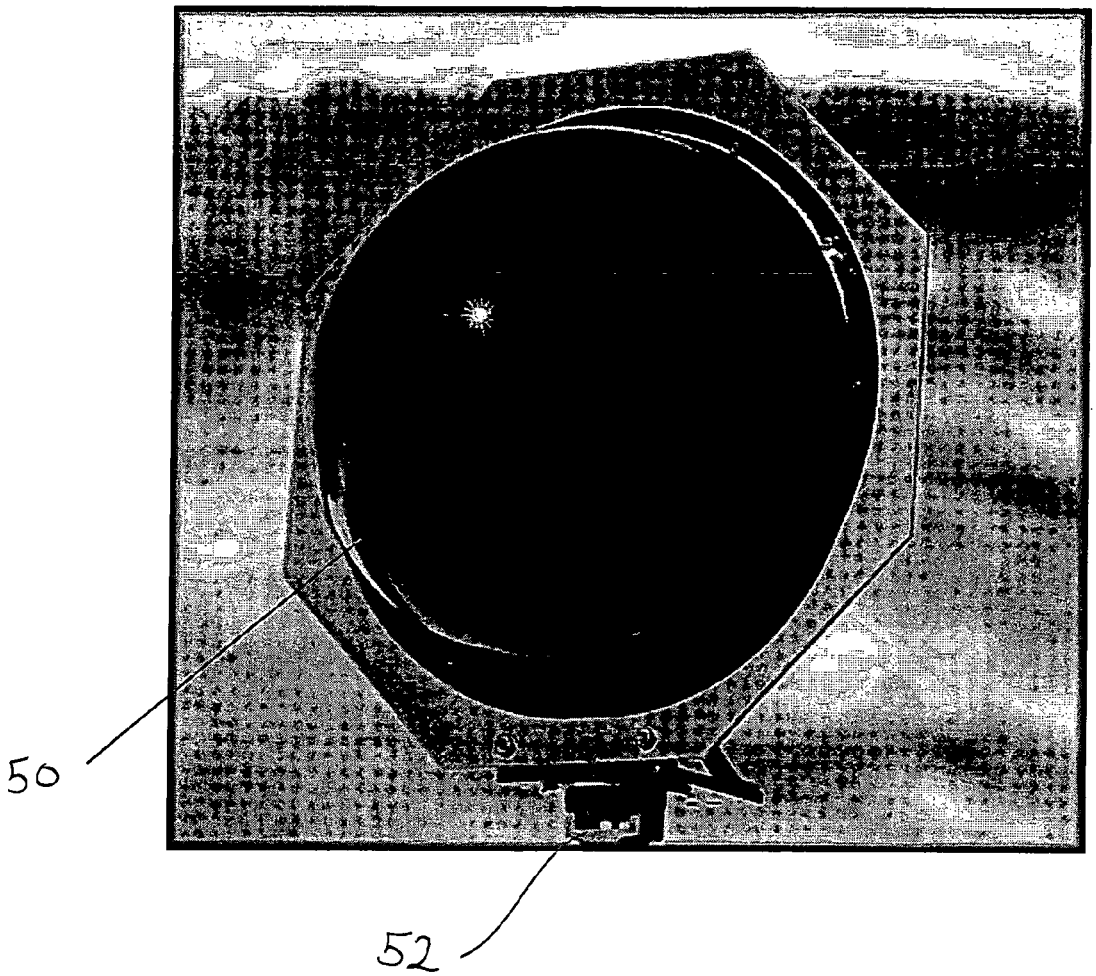
FIG. 5 is a perspective view of a preferred embodiment of a hemispherical helix antenna including a support frame and a cover.

With reference to the drawings wherein like numerals represent like elements throughout the various views, a hemispherical helical antenna is generally designated by the number 10. The hemispherical helical antenna 10 includes a support frame assembly 22 that is uniquely configured to provide for efficient and effective mounting of hemispherical helical antennas used in the broadcasting and receiving of UHF wireless band signals. Different views of an exemplary embodiment of the support frame assembly 22 are illustrated in FIGS. 2A-2C. Generally, the hemispherical helical antenna 10 is principally comprised of a hemispherical antenna element 20, a support frame assembly 22, a ground plane 24, a plurality of mounting brackets 26, and a covering member 50. A mounting assembly 52, which may assume various forms and functions, optimally mounts the antenna 10 at a selected orientation as illustrated in FIG. 5.

The hemispherical antenna element 20 is preferably fabricated from a single uniform thickness wire, typically composed of copper. As shown in FIG. 2A, the element 20 is configured to form a helix preferably having between 3 to 10 windings or turns, which are generally shaped in the form of half of a sphere (i.e., a hemisphere). The central axis 32 of the helix intersects the functional center 33 of the ground plane 24. As illustrated in FIG. 2B, the windings of the helix are diamentrally widest at points closer to the ground plane 24 and become considerably narrower as the element 20 reaches the top 31 of the axis at the center of the ground plane 24.

In a preferred embodiment, the element 20 begins at a point that is farthest from the axis 32 and ends at the axis at the element point farthest from the ground plane 24. It is also preferred that the windings of the element 20 extend in a counterclockwise rotation as viewed in FIG. 2B. There is a fixed constant spacing S between adjacent turns of the element 20. In a preferred embodiment, the spacing S between adjacent turns of the element 20 is 1.005 inches. The element 20 is spaced above the ground plane 24 at a distance D 24. In a preferred embodiment the distance D is 1.050 inches.

Generally, the spherical coordinates of the helix wire along its axis is determined by the following equation:

$$r = a, \quad \theta = \cos^{-1}\left[+\left(\frac{\phi}{2\pi N} - 1\right)\right], \quad 2\pi N \le \phi \le 4\pi N$$

The radius of the hemisphere is a.

The number of turns in the helix is N.

The circumference of the hemisphere=the wavelength of the antenna at its lowest working frequency.

The distance of the first point of the element from the ground plane=wavelength/0.0415.

As shown in FIGS. 2B and 2C, the ground plane 24 is a flat panel of metal that is substantially square. The functional center 33 of the ground plane 24 is where all points of the element 20 are derived. The distance W between the center 33 of the ground plane 24 and the edge 25 of the ground plane is approximately equal to one quarter of the antenna wavelength. In a preferred embodiment, W is 7 inches.

As shown in FIG. 2B, the support frame assembly 22 is preferably comprised of at least three (3) substantially flat interlocking panels 34, 35, and 36, which are made of a dielectric substance. In a preferred embodiment, the panels are made of Lexan® material and the thickness of each panel 34 is between 1/32" and 3/16". It is also preferred that each panel 34, 35, and 36 is fastened to the ground plane 24 in at least two points 30*a* and 30*b* by mounting brackets 26. Preferably, the mounting brackets are "L" shaped brackets (such as Keystone™ #618).

Figure 3A:
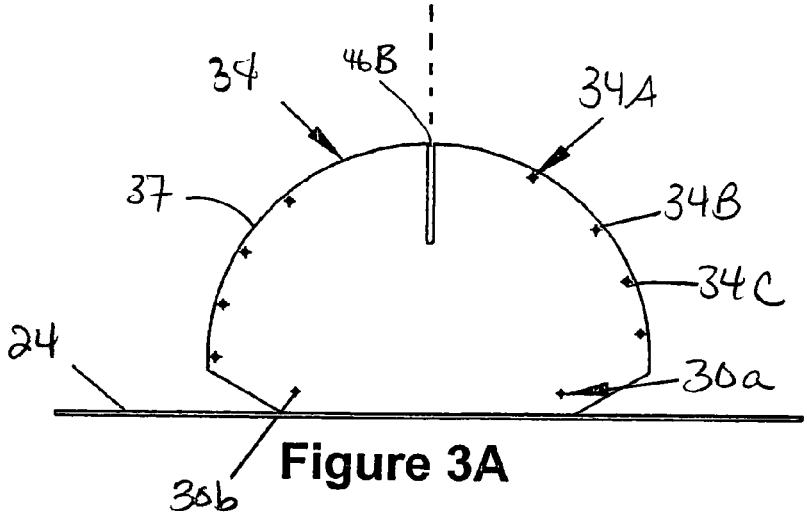
FIGS. 3A-3C are elevational views of support components for the embodiment of FIG. 2A, each Figure illustrating the configuration of a single support panel relative to a base.
Figure 3B:
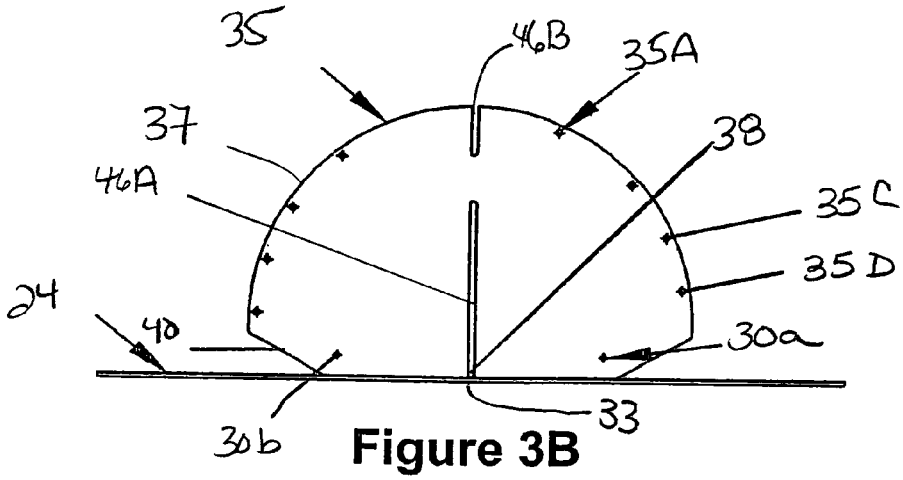
Figure 3C:
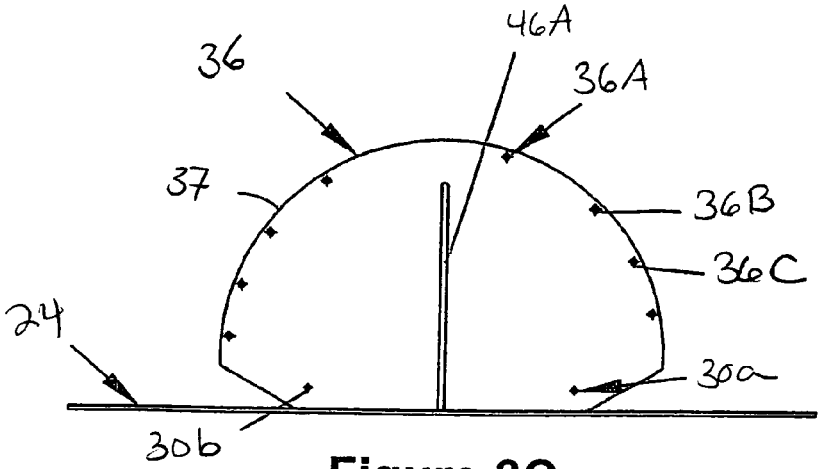
Figure 4:
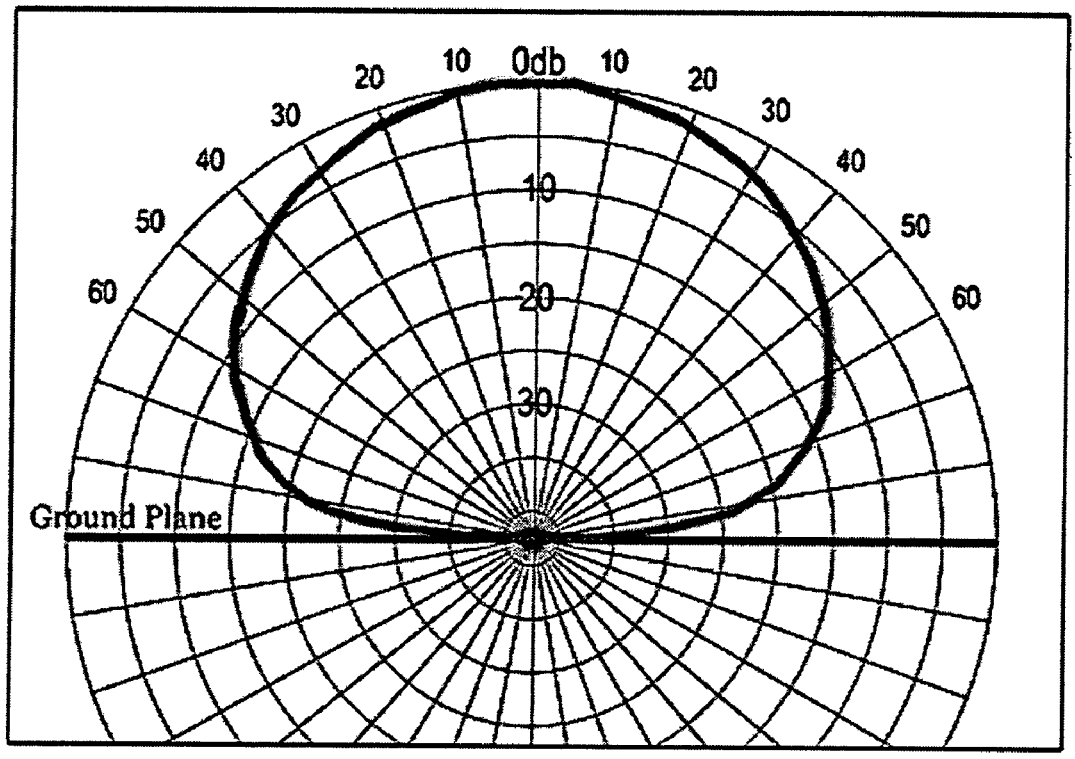
FIG. 4 is a graph representing the gain for the antenna of FIG. 2A.

As shown in FIGS. 3A-3C, points 30*a* and 30*b* are located along the base 40 of each panel, at a distance that is approximately half the helix radius or greater from the center 33 of the ground plane 24. Mounting points 30*a* and 30*b* are located opposite to each other, one on each side of the center 33 of the ground plane 24.

It should be understood that each of the panels 34, 35, and 36 of the support frame assembly is substantially perpendicular to the ground plane 24 and oriented with its respective center point 38 of the base 40 aligned with the center point 33 of the ground plane. Accordingly, each panel has a center line 44 that is substantially coaxial and parallel to the axis 32.

Each panel 34, 35, and 36 is further provided with a series of selectively positioned openings to accommodate the element 20. In a preferred embodiment, each panel 34, 35, and 36 has a series of discrete openings 34A, 34B, 34C, 35A, 35B, 35C, 36A, 36B, 36C, etc. arranged in regular intervals along the substantially arcuate edge 37 of the respective panel. It is further preferred that these openings are slightly larger than the diameter of the element 20 and allow the element 20 to pass easily through the panel. The walls of the openings and particularly the lower portions thereof (relative to the ground plane 24) function as positional locators and supports for the element. Preferably, the element 20 is threaded through openings 34A, 34B, 34C, 35A, 35B, 35C, 36A, 36B, 36C, etc. which are substantially circular holes in the panel surface. In another embodiment, the openings 42 may be thin slits or notches that extend radially inward from the edge of the panel. According to this embodiment, the element rests at the bottom of the notch.

In a preferred embodiment, the support frame assembly 22 is comprised of three (3) panels 34, 35, and 36, each panel being oriented at about 60 degrees from each of the other panels. Accordingly, one panel 34 (FIG. 3A) will intersect the element 20 at the 0 degree plane and at the 180 degree plane. The second panel 35 (FIG. 3B) will intersect the element 20 at the 60-degree plane and the 240-degree plane. The third panel 36 (FIG. 3C) will intersect the element 20 at the 120-degree plane and the 300-degree plane. It is further preferred that each of the panels 34, 35, and 36 has a thin section of material removed along at least one portion of the center line 44 to form at least one slot 46 in each of the panels 34, 35, and 36. The relative configuration of the slots 46 will allow the panels to be interlocked and oriented in the manner previously described. It is preferred that the diameter of the slots 46 is approximately equal to twice the thickness of the material comprising the panels. Preferably, the panels can be interlocked without physical interference with the remaining panels and the preferred interlocking configuration provides structural stability to the support frame assembly 22.

As shown in FIGS. 3A-3C, each panel has a unique pattern in which the section of material is removed from along its center line 44 to form the slots 46. In a preferred embodiment where the support frame assembly 22 has three panels 34, 35, and 36, one panel 36 will have a single slot 46A that extends upwards from the base 40 of the panel. A second panel 35 will have two slots 46A and 46B, where one slot 46B extends downwardly from the top and the second slot 46A extending upwards from the base 40. As shown in FIG. 3B, it should be understood that a section of material remains in-between the slots 46A and 46B. In the third panel 34 the slot 46B will extend downwardly from the top of the panel.

It should also be understood that the preferred configuration of medial slots 46 (described above) minimizes the number of components in the support frame assembly 22 by allowing each panel to pass through the center vertical plane while keeping the other panels intact. This will also provide for the efficient interlocking assembly and orientation of the three panels 34, 35, and 36.

In one preferred embodiment, the maximum diameter of the panels 34 is approximately 11½ inches and the vertical height of the arc above the ground plane 24 is approximately 5½ inches. In another preferred embodiment, the ground plane 34 may be configured as a regular octagon with a maximum diameter (i.e. the distance between two opposite vertices) of about 14 inches. Once the panels of the support frame assembly 22 are erected and secured to the ground plane 24, the element 20 is sequentially passed through the openings to form the hemispherical helical antenna as illustrated in FIGS. 2A, 2B and 2C.

It should be understood that the support frame assembly 22 is not limited by the number or the shape of the panels. In another embodiment, the support frame assembly may be comprised of two panels. The two panels are perpendicular to each other on the ground plane. Similarly, the panels are not limited to substantially arcuate shapes. In other embodiments, the panels may be formed in a wide range of shapes having a number of precisely located openings to receive the element and form a hemispherical helical antenna.

The antenna support frame assembly may further include a covering member 50 which encloses the element 20 and the panels of the support frame assembly 22. In one preferred embodiment, the covering member 50 is a black acrylic dome. The covering member 50 has a curvature which complements the arcuate curvature of the edges of the panels.

FIG. 5 depicts a hemispherical helical antenna 10 that incorporates one preferred embodiment of the foregoing support frame assembly 22 and employs an aesthetically pleasing covering member 50. In one embodiment the combination of the antenna 10 and the support frame assembly 22 has RF performance characteristics that are extremely desirable for usage in the broadcast UHF wireless band, both as a transmitting and a receiving device.

Characteristics for one example of a hemispherical helical antenna 10 and support frame assembly 22 (shown in FIG. 5) are described below:

| | |
|---|---|
| Antenna | Circular Polarized Helical |
| Gain | 8 dbi over most of the Wireless band |
| Bandwidth | 450-950 MHz |
| Frequency @Maximum Gain | 650 MHz (typically 9.5 dbi) |
| Polarization | Circular |

-continued

| | |
|---|---|
| Connector Type | N |
| Half Power Beam Width | 40 degrees |
| SWR | 1.5:1 (or better) |
| Power | 50 Watts |
| Radome Depth | 5.5" |
| Ground Plane Diameter | 14" (6061 Anodized Aluminum) |
| Mounting Bracket | 2" × 1.5" Black Nylon Block with ⅜-16 Helicoil and 2 Mic Stand adaptors |
| Radome Material | Black Acrylic |
| Element | Copper |
| Element Support | Lexan ™ material |
| Hardware | Stainless Steel |

While preferred embodiments of the foregoing invention have been set forth for the purpose of description, the foregoing description should not be deemed a limitation of the invention herein. Accordingly, various modifications, adaptations and alternatives may be employed without departing from the spirit and scope of the invention.

What is claimed:

1. A hemispherical helical antenna assembly comprising:

a base;

a support frame comprising a plurality of interlocking panels each perpendicular to said base and oriented at a fixed angular orientation relative to a central axis and anchored to said base, each panel defining a series of selectively located openings; and an element extending through said openings and having a plurality of turns disposed around said central axis to form a hemispherical helix, wherein the element has spherical coordinates along its central axis substantially defined by the formula:

$$T = a,\ \theta = \cos^{-1}\left[+\left(\frac{\phi}{2\pi N} - 1\right)\right],\ 2\pi N \le \phi \le 4\pi N$$

where:

the radius of the hemisphere is a the number of turns in the helix is N; and a cover member disposed over said support frame and enclosing said element.

2. The antenna assembly of claim 1 wherein the support frame is comprised of three centrally interlocking panels each angularly spaced to define a 60° angle between adjacent panels.

3. The antenna assembly of claim 2 wherein each panel has an outer edge and said openings are equidistantly spaced from said outer edge.

4. The antenna assembly of claim 1 wherein each of said plurality of panels has at least one slot substantially coaxial with said central axis.

5. The antenna assembly of claim 1 wherein said plurality of panels are comprised of dielectric material.

6. The antenna assembly of claim 1 wherein said cover member is substantially dome shaped.

7. A hemispherical helical antenna assembly comprising:

a substantially planar ground base;

a support frame comprising a plurality of panel members mounted to said ground base and having at an arcuate edge, a second edge, and a central axis portion defined by at least one slot that centrally traverses said panel members, said members disposed at fixed angles to one another;

each of said plurality of panel members forming a series of supports positioned at regular intervals along said second edge with at least two supports on opposite sides of said central axis portion, and at least one slot configured to receive the central axis portion of at least one of said plurality of panel members in an interlocking manner;

an element supported by through said supports and wound in a helix having between 3 to 10 turns and a hemispherical configuration with a height H; and a cover member enclosing said element and panel members.

8. The antenna assembly of claim 7 having three panel members each disposed at a 60° angle to one another.

9. The antenna assembly of claim 8 wherein each of said panel members is secured in a perpendicular orientation to said ground base along said panel members first edge by at least two bracket members, one on each side of said central axis portion.

10. The antenna assembly of claim 7 wherein said ground base is configured as a regular octagon with a maximum distance between two opposite vertices of about 14 inches.

11. The antenna assembly of claim 10 wherein the arcuate edge of each of said panel members has a maximum diameter of approximately 11½ inches.

12. The antenna assembly of claim 11 wherein the height H is approximately 5½ inches.

13. The antenna assembly of claim 7 having three panel members each with at least one medial slot comprising: a first panel member having a single medial slot along said central axis portion extending from said first edge toward said second edge; a second panel member having two medial slots along said central axis portion, one slot extending from said first edge toward said second edge and another slot extending from said second edge toward said first edge; and a third panel member having a single medial slot along said central axis portion extending from said second edge toward said first edge.

14. The antenna assembly of claim 7 wherein said supports are at least partially defined by openings.

15. The antenna assembly of claim 7 wherein the element has spherical coordinates along its central axis substantially defined by the formula:

$$T = a,\ \theta = \cos^{-1}\left[+\left(\frac{\phi}{2\pi N} - 1\right)\right],\ 2\pi N \le \phi \le 4\pi N$$

where: the radius of the hemisphere is a the number of turns in the helix is N.

16. A hemispherical helical antenna comprising:

a ground base;

a conductor having a generally helical configuration;

a plurality of interlocking panels of dielectric material mounted in perpendicular relationship to said base and oriented at a fixed angular orientation to define a central vertical axis and configured to intersect said conductor at a plurality of angular orientations; and each of said panels being substantially planar and defining a center point in the plane of said panel and forming an array of angularly spaced supports equidistantly radially spaced from said center point and intersecting said conductor in at least two angular orientations, wherein said conductor is supported sequentially by said supports to form a substantially hemispherical helical shape with a height H.

17. The antenna of claim 16 having three interlocking panels wherein a first panel intersects said conductor at angular orientations of 0 and 180 degrees; a second panel intersects said conductor at angular orientations of 60 and 240 degrees; and a third panel intersects said conductor at angular orientations of 120 and 300 degrees.

18. The antenna of claim 16 wherein said supports are at least partially defined by openings.

19. The antenna of claim 16 further comprising a substantially dome shaped cover enclosing said conductor and panels.

20. The antenna assembly of claim 16 wherein the conductor has spherical coordinates along its central axis substantially defined by the formula:

$$T = a,\ \theta = \cos^{-1}\left[+\left(\frac{\phi}{2\pi N} - 1\right)\right],\ 2\pi N \le \phi \le 4\pi N$$

where: the radius of the hemisphere is a the number of turns in the helical configuration is N.

* * * * *

UNITED STATES PATENT AND TRADEMARK OFFICE

CERTIFICATE OF CORRECTION

PATENT NO. : 7,714,796 B1
APPLICATION NO. : 11/493186
DATED : May 11, 2010
INVENTOR(S) : Schumacher It is certified that error appears in the above-identified patent and that said Letters Patent is hereby corrected as shown below:

Column 5:

Line 37, delete "$T = a$," and substitute -- $r = a$, --.

Column 6:

Line 47, delete "$T = a$," and substitute -- $r = a$, --.

Column 8:

Line 7, delete "$T = a$," and substitute -- $r = a$, --.

Signed and Sealed this

Twenty-eighth Day of September, 2010

David J. Kappos

David J. Kappos
*Director of the United States Patent and Trademark Office*